US006470855B1

(12) United States Patent
Frank et al.

(10) Patent No.: US 6,470,855 B1
(45) Date of Patent: Oct. 29, 2002

(54) HIGH-PRESSURE FUEL RESERVOIR FOR A FUEL INJECTION SYSTEM FOR INTERNAL COMBUSTION ENGINES

(75) Inventors: Kurt Frank, Schorndorf; Helmut Knoedl, Marbach-Rielingshausen; Henning Kreschel, Ludwigsburg; Friedrich Boecking, Stuttgart; Steffen Jung, Leonberg, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/807,189

(22) PCT Filed: Aug. 11, 2000

(86) PCT No.: PCT/DE00/02750

§ 371 (c)(1),
(2), (4) Date: Sep. 7, 2001

(87) PCT Pub. No.: WO01/12980

PCT Pub. Date: Feb. 22, 2001

(30) Foreign Application Priority Data

Aug. 11, 1999 (DE) ..... 199 37 946

(51) Int. Cl.[7] ..... F02M 37/04
(52) U.S. Cl. ..... 123/456; 123/468
(58) Field of Search ..... 123/456, 468, 123/469, 470

(56) References Cited

U.S. PATENT DOCUMENTS

| | | | | |
|---|---|---|---|---|
| 5,168,856 A | * | 12/1992 | Lorraine | 123/468 |
| 5,775,302 A | * | 7/1998 | Guido et al. | 123/468 |
| 6,186,119 B1 | * | 2/2001 | Ciecko | 123/456 |
| 2001/0009148 A1 | * | 7/2001 | Asade et al. | 123/456 |

* cited by examiner

*Primary Examiner*—Thomas N. Moulis
(74) *Attorney, Agent, or Firm*—Ronald E. Greigg

(57) ABSTRACT

A high-pressure fuel reservoir is proposed in which the hydraulic connection between the connection fitting and the reservoir chamber is produced by a number of connecting bores. This reduces the stress peaks in the vicinity of the intersections of the connecting bore and reservoir chamber so that the compression capacity of the high-pressure fuel reservoir increases.

14 Claims, 2 Drawing Sheets

HIGH-PRESSURE FUEL RESERVOIR FOR A FUEL INJECTION SYSTEM FOR INTERNAL COMBUSTION ENGINES

CROSS-REFERENCE TO RELATED APPLICATIONS

This application is a 35 USC 371 application of PCT/DE 00/02750 filed on Auq. 11, 2000.

BACKGROUND OF THE INVENTION

1. Field of the Invention

The invention is based on a high-pressure fuel reservoir for a fuel injection system for internal combustion engines, with a reservoir chamber and at least one connection fitting.

2. Description of the Prior Art

In high-pressure fuel reservoirs of this kind, stress peaks occur in the vicinity of the intersection between the inner wall of the reservoir chamber and the bore that connects the reservoir chamber and connection fitting. This results in the danger of the high-pressure fuel reservoir breaking in this region, particularly because the reservoir chamber is subjected to pulsating compressive strain. Various endeavors are undertaken in order to reduce this breakage risk.

One logical possibility is to increase the wall thickness of the high-pressure fuel reservoir. However, there are limitations placed on the wall thickness of the high-pressure fuel reservoir because thick-walled bodies tend to fracture under high, pulsating compressive strain, primarily in the vicinity of wall openings and sharp-edged cross-sectional changes.

DE-OS 196 40 480 A1 has disclosed a cylindrical high-pressure fuel reservoir in which the longitudinal axis of the bore that connects the reservoir chamber and the connection fitting is a secant of the circular reservoir chamber cross section. This results in a reduction of the stresses in the vicinity of the intersection between the bore and the inner wall of the reservoir so that the loading capacity and service life of the high-pressure fuel reservoir are increased.

OBJECT AND SUMMARY OF THE INVENTION

The object of the invention is to produce a high-pressure fuel reservoir with increased compression capacity, particularly for pulsating compressive strain.

This object is attained according to the invention by means of a high-pressure fuel reservoir in which the reservoir chamber and the connection fitting are hydraulically connected by means of a number of connecting bores. This has the advantage that with the same a hydraulic diameter, the stress peaks produced by the smaller connecting bores are lower than those produced with a single large diameter bore. This increases the compression capacity and service life of the high-pressure fuel reservoir. In addition, the high-pressure fuel reservoir can be adapted to various conditions of use by changing the number and diameter of the connecting bores while simultaneously optimizing the manufacturing costs. Fundamentally, a large number of small diameter connecting bores results in a high compression capacity of the high-pressure fuel reservoir.

In one embodiment of the invention, the reservoir chamber is cylindrical so that can be simply and inexpensively produced.

Another variant provides a spherical reservoir chamber so that except for the connecting regions with the connecting bores, a uniform stress state prevails in the reservoir.

One embodiment of the invention provides for embodying the geometry of the reservoir chamber arbitrarily so that an optimal adaptation to the prevailing stress states is achieved.

In another embodiment of the invention, the connecting bores feed into a collecting bore of the connection fitting so that the connection fitting can be attached in a known manner to a high-pressure line.

In a further development of the invention, one or a number of connecting bores feed into the reservoir chamber tangentially so that the stress peaks produced by the connecting bores are further reduced.

In another embodiment of the invention , the connecting bores feeding into the reservoir chamber tangentially have a larger diameter than the connecting bores that feed into the reservoir chamber non-tangentially so that the stress peaks produced by the connecting bores are approximately equal and consequently the strength of the material is exploited in the best possible way.

In another embodiment of the invention, a high-pressure fuel reservoir is produced by forging so that the material properties are improved.

Another alternative provides that at least one fastening tab is disposed on the high-pressure fuel reservoir so that the reservoir can be simply and securely installed in the vehicle.

In another embodiment of the invention, the high-pressure fuel reservoir is comprised of a tube with a welded-on connection fitting so that production is simplified.

BRIEF DESCRIPTION OF THE DRAWINGS

Additional features of the invention can be will be apparent from the detailed description contained below, taken with the drawings, in which.

DESCRIPTION OF THE PREFERRED EMBODIMENTS

Figure 1:
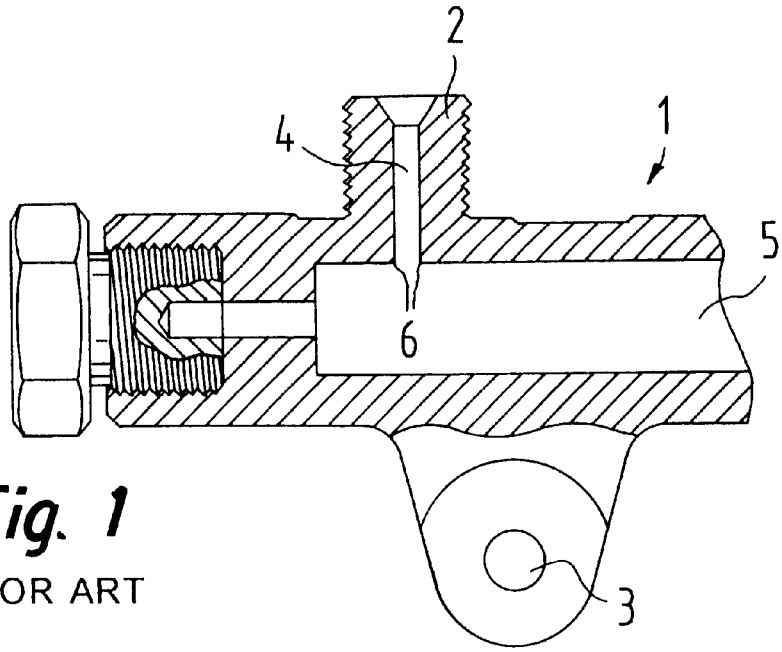
Fig. 1 PRIOR ART
FIG. 1 is a partial longitudinal section through a cylindrical high-pressure fuel reservoir according to the prior art.

FIG. 1 is a partial longitudinal section through a high-pressure fuel reservoir 1 according to the prior art. The high-pressure fuel reservoir has one or a number of connection fittings 2 only one of which is shown in FIG. 1. A fastening tab 3 for mounting the reservoir is also shown. The connection fitting 2 has a bore 4 which hydraulically connects the connection fitting 2 to the reservoir chamber 5. The region 6 of the intersection between the bore 4 and the reservoir chamber 5 faces the highest risk of breakage because the stresses in the intersecting region 6 increase with increasing diameter of the bore 4. However, the diameter of the bore 4 must be selected to be as large as possible in order to limit the throttling action of the bore 4.

Figure 2:
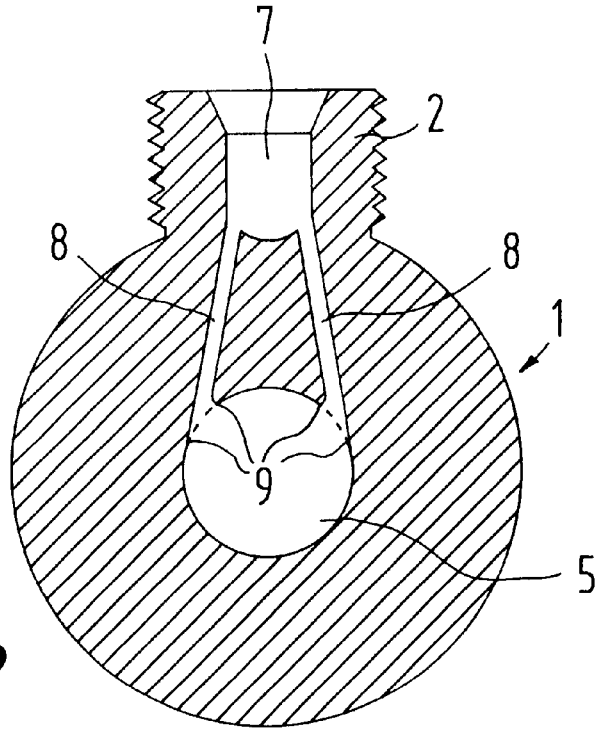
FIG. 2 is a cross section through a high-pressure fuel reservoir according to the invention.

FIG. 2 is a cross section of a high-pressure fuel reservoir 1 according to the invention. In its upper part, the connection fitting 2 has a collecting bore 7, which splits into two connecting bores 8. This has the advantage that the diameter of the connecting bores 8 is relatively small in relation to the diameter of the reservoir chamber 5. As a result, the stresses are relatively low in the intersecting regions 9.

In the example shown, the connecting bores 8 feed into the reservoir chamber 5 tangentially. This has the additional advantage that with the connecting bores 8 feeding tangentially into the reservoir chamber 5, the individual stresses are merely vectorially superposed so that there is a further reduction of the stresses.

Figure 3A:
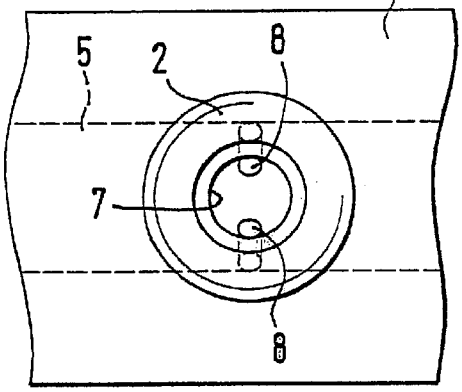
FIGS. 3*a* and 3*b* are top views of two embodiments of a high-pressure fuel reservoir according to the invention.

FIG. 3*a* is a top view of a high-pressure fuel reservoir 1 according to the invention, with a connection fitting 2. It is clear that starting from the collecting bore 7, two connecting bores 8 feed into the reservoir chamber 5, which is only shown with dashed lines.

Figure 3B:
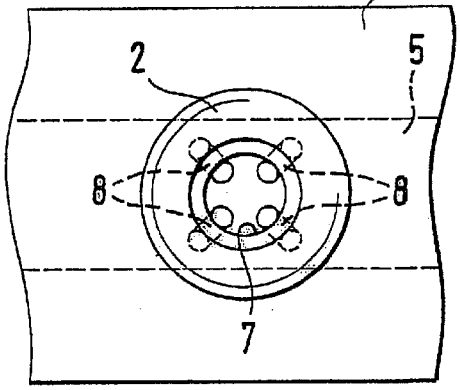

FIG. 3*b* is a top view of an embodiment of the invention with four connecting bores 8. It goes without saying that the number and disposition of the connecting bores 8 can be chosen in accordance with the required hydraulic diameter, working pressure of the reservoir, and strength of the reservoir material.

Figure 4A:
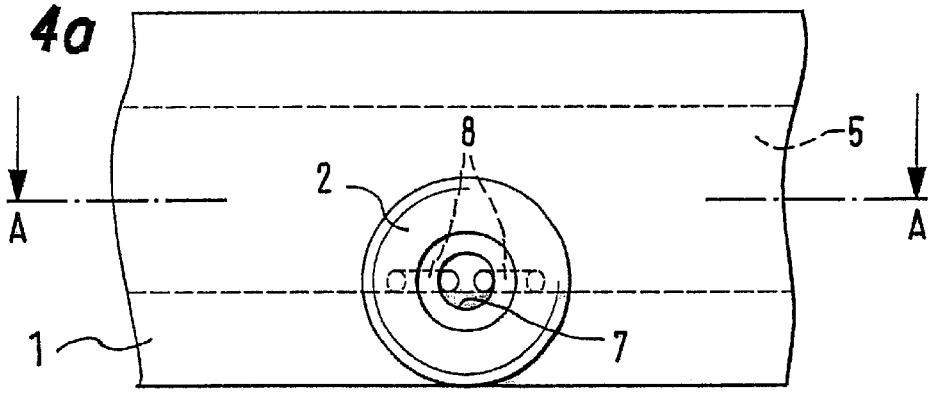
FIGS. 4*a* and 4*b* are respectively a top view and a longitudinal section through another embodiment of a high-pressure fuel reservoir according to the invention.

FIG. 4*a* is a top view of another exemplary embodiment of a high-pressure fuel reservoir 1 according to the invention. In this embodiment, the connection fitting 2 is offset from the center with regard to the longitudinal axis of the high-pressure fuel reservoir. This offset results in the fact that the connecting bores 8 feed into the reservoir chamber 5 tangentially.

Figure 4B:
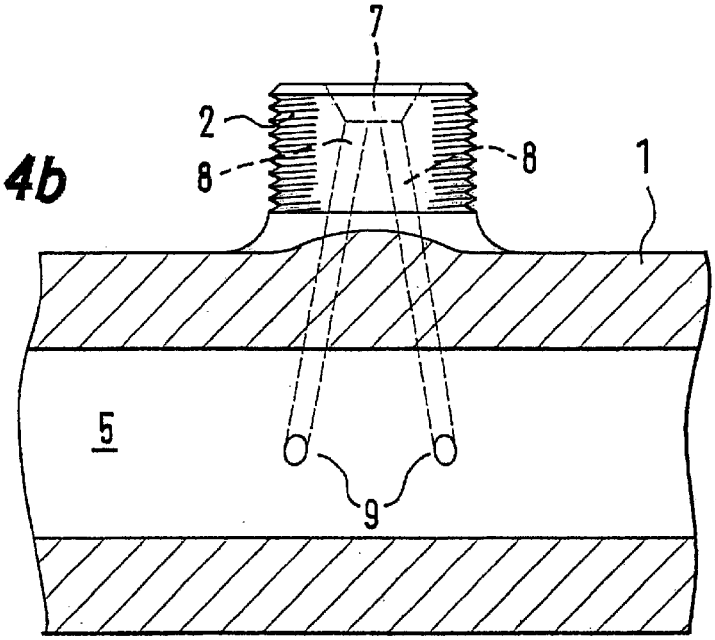

FIG. 4*b* is a longitudinal section along the line A—A of a high-pressure fuel reservoir 1 shown in FIG. 4*a*. This depiction clearly shows the intersecting regions 9 of the connecting bores 8 and the reservoir chamber 5. The connecting bores 8 feeding tangentially into the reservoir chamber 5 results in a reduction of the stresses in the intersecting regions 9.

The foregoing relates to preferred exemplary embodiments of the invention, it being understood that other variants and embodiments thereof are possible within the spirit and scope of the invention, the latter being defined by the appended claims.

We claim:

1. A high-pressure fuel reservoir (1) for a fuel injection system for internal combustion engines comprising a uniformly contoured reservoir chamber (5) and at least one connection fitting (2), and a number of connecting bores (8) between the reservoir chamber (5) and each said connection fitting (2), whereby the connecting fitting (2) serves to integrally reinforce the reservoir chamber (5) and thereby mitigate the mechanical stress due to any pressure build up caused by the fuel within the fuel reservoir (1).

2. The high-pressure fuel reservoir (1) according to claim 1, wherein the reservoir chamber (5) is cylindrical.

3. The high-pressure fuel reservoir (1) according to claim 1, wherein the connecting bores (8) feed into a collecting bore (7) of the connection fitting (2).

4. The high-pressure fuel reservoir (1) according to claim 1, wherein at least one of said connecting bores (8) feed into the reservoir chamber (5) tangentially.

5. The high-pressure fuel reservoir (1) according to claim 4, further comprising connecting bores (8) feeding into the reservoir chamber (5) non-tangentially, and wherein said at least one tangential connecting bore has a larger diameter than the connecting bores (8) that feed into the reservoir chamber (5) non-tangentially.

6. The high-pressure fuel reservoir (1) according to claim 1, wherein the high-pressure fuel reservoir (1) is produced by means of forging.

7. The high-pressure fuel reservoir (1) according to claim 1, wherein at least one fastening tab (3) is disposed on the high-pressure fuel reservoir (1).

8. The high-pressure fuel reservoir (1) according to claim 1, wherein the high-pressure fuel reservoir (1) is comprised of a tube with a welded-on connection fitting (2).

9. The high-pressure fuel reservoir (1) according to claim 2, wherein the connecting bores (8) feed into a collecting bore (7) of the connection fitting (2).

10. The high-pressure fuel reservoir (1) according to claim 2, wherein at least one of said connecting bores (8) feed into the reservoir chamber (5) tangentially.

11. The high-pressure fuel reservoir (1) according to claim 3, wherein at least one of said connecting bores (8) feed into the reservoir chamber (5) tangentially.

12. The high-pressure fuel reservoir (1) according to claim 2, wherein further comprising connecting bores (8) feeding into the reservoir chamber (5) non-tangentially, and wherein the tangential connecting bores have a larger diameter than the connecting bores (8) that feed into the reservoir chamber (5) non-tangentially.

13. The high-pressure fuel reservoir (1) according to claim 2, wherein the high-pressure fuel reservoir (1) is produced by means of forging.

14. The high-pressure fuel reservoir (1) according to claim 2, wherein at least one fastening tab (3) is disposed on the high-pressure fuel reservoir (1).

* * * * *